US006951476B1

(12) United States Patent
Saito et al.

(10) Patent No.: US 6,951,476 B1
(45) Date of Patent: Oct. 4, 2005

(54) ELECTRICAL CONNECTOR

(75) Inventors: Hajime Saito, Mission Viejo, CA (US); Masahide Watanabe, Irvine, CA (US); Kentaro Toda, Hino (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/086,164

(22) Filed: Mar. 22, 2005

(51) Int. Cl.[7] ..... H01R 12/24
(52) U.S. Cl. ..... 439/495; 439/499
(58) Field of Search ..... 439/357, 456, 439/459, 495, 496, 499

(56) References Cited

U.S. PATENT DOCUMENTS 6,165,008 A * 12/2000 Wu et al. ..... 439/492
6,210,209 B1 * 4/2001 Wu et al. ..... 439/495
6,231,378 B1 * 5/2001 Wu et al. ..... 439/495

* cited by examiner

*Primary Examiner*—Thanh-Tam Le
(74) *Attorney, Agent, or Firm*—Koda & Androlia

(57) ABSTRACT

An electrical connector for a flat type cable that has at its one end portion a stiff backup element, including an insulating housing having a cavity for receiving the end portion of the flat cable, a retaining member formed with a retainer block which has flat surfaces and is inserted in the cavity of the insulating housing, and a holding member engaged with the retaining member and has connecting arms that connect the holding member to the insulating housing with the retaining member in between, so that the end portion of the flat cable takes a crank shape inside the connector and the stiff backup element unbendable inside the connector prevents the cable from being pulled out of the connector.

3 Claims, 4 Drawing Sheets

ELECTRICAL CONNECTOR

BACKGROUND OF THE INVENTION

1. Filed of the Invention

The present invention is related to an electrical connector and more particularly to an electrical connector for flat type cables.

2. Prior Art

Flat type cables such as flexible flat cables ("FFC") and flexible printed cables ("FPC") are widely used in electric and electronic appliances and more specifically in computers, computer peripherals and computer devices, and they are connected to such appliances via electrical connectors.

The flat type cables are held by a connector in various manners. In one typical manner to connect a flat cable to a connector, the end of the cable is, as shown in FIG. 4A, shaped in letter "T", and the both side edges of this T-shaped end are hooked to a connector. In another type of connection, as shown in FIG. 4B, the end portion of a cable is formed with holes so that the cable end is inserted into the cavity of a connector or its connector shell, and pins or spring pins, or other fastening means, are passed through the connector shell and the holes of the cable, thus securing the cable to the connector.

However, in the above-described most commonly employed connections, cables need to be worked so as to be in a T-shape at the end or to be formed with holes, requiring extra work and causing the manufacturing costs and sale prices to increase.

SUMMARY OF THE INVENTION

It is, therefore, an object of the present invention to provide an electrical connector that connects flat type cables securely to the connector without needing extra work.

The above object is accomplished by a unique structure of the present invention for an electrical connector for a flat type cable that has at its one end portion a backup element which is stiffer than the cable; and in the present invention, the connector comprises:

- an insulating housing that has on its side a cavity for receiving the end portion of the cable and further has terminals on its another side for being connected to an electric device,
- a retaining member that has a retainer block being formed with one flat surface(s) and slidably inserted into the cavity of the insulating housing, and
- a holding member that is engaged with the retaining member and has a connecting means that holds the insulating housing and the retaining member together; and wherein
- the backup element of the cable is held between the inner surface of the cavity of the insulating housing and the flat surface of the retaining member, and the end portion of the cable is put into a crank shape between the retaining member and the holding member.

In the above structure of the connector of the present invention, the three components of the connector, which are the insulating housing, the retaining member and the holding members, form the inside thereof into a crank-shape cable path, so that the end portion of the cable takes a crank shape accordingly inside the crank-shape cable path. As a result, since a backup element is formed in the end portion of the cable, is stiff (or at least stiffer than the cable), is not bent in a crank-shape path and is caught in the angled portion of the crank-shape cable path, the cable is prevented from being pulled out of the connector and is securely connected to the connector.

DETAILED DESCRIPTION OF THE INVENTION

Figure 1:
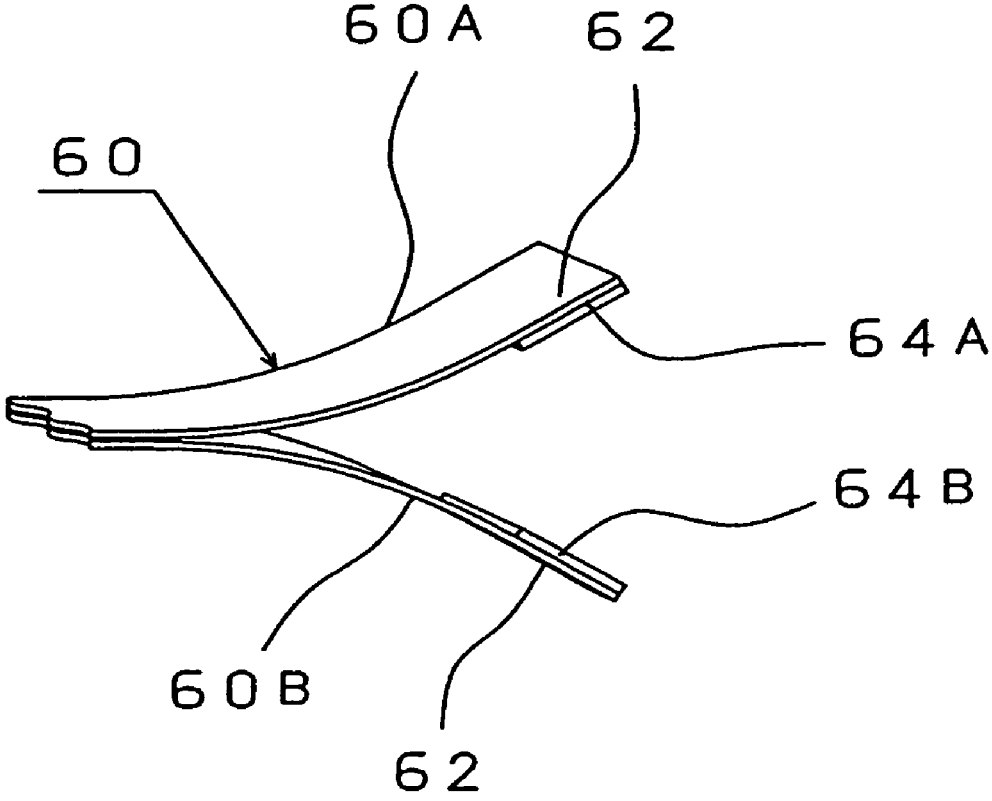
FIG. 1 illustrates one type of a flat type cable used in the connector according to the present invention.

The electrical connector 10 for flat type cables of the present invention comprises: an insulating housing 20, a retaining member 30 and a holding member 40 that are made of plastic and are disengageably connected to each other to form an integral unit. The insulating housing 20, retaining member 30 and holding member 40 are substantially the same in the width (or lateral direction) W and in the height (or vertical dimension) H.

The electrical connector 10 of the present invention is used for a flat type cable (called "flat cable" or merely "cable" below) such as a flexible flat cable ("FFC") and a flexible printed cable ("FPC") that is, as seen from FIG. 1, a laminated cable 60 which is currently marketed and comprises a first cable element 60A and a second cable element 60B. Each one of the cable elements 60A and 60B consists of one or more flat conductors laid parallel at a specified pitch and laminated between two layers of dielectric which is typically 1 mil or 2 mils of polyester film and combined into a single cable 60 and further has backup elements 64A and 64B.

More specifically, the end portion of each one of the cable elements 60A and 60B that form the cable 60 has, on an outside thereof, conductor contact area 62 formed by directly and partially exposing conductors of the conductor groups so that conductors of the conductor contact areas 62 are electrically connected to the conductors provided inside the insulating housing 20. In addition, the first cable element 60A (or an "upper" cable element 60A in FIG. 1) has a backup element 64A on the inner surface of the end portion, and the second cable element 60A (or a "lower" cable element 60 in FIG. 1) has a backup element 64B on the inner surface of the end portion, so that the backup elements 64A and 64B face each other. Each one of the backup elements 64A and 64B is made of, for instance, resins, glass fibers, etc. and is in a rectangular shape of, for instance, 1'×¼' for a one-inch flat cable; and it is made of a relatively hard material, thus being stiffer than at least the cable elements 60A and 60B. The backup elements 64A and 64B are provided for substantially the entire width of the cable elements 60A and 60B of the flat cable 60.

The flat cable 60 used for the connector 10 of the present invention can be a single-stage (or a single layer) cable, unlike the above-described double-layered cable in which two cable elements 60A and 60B are combined together on their inner surfaces with the exposed conductors or the conductor contact areas 62 facing outward and the backup elements 64A and 64B facing inward as shown in FIG. 1.

Figure 2:
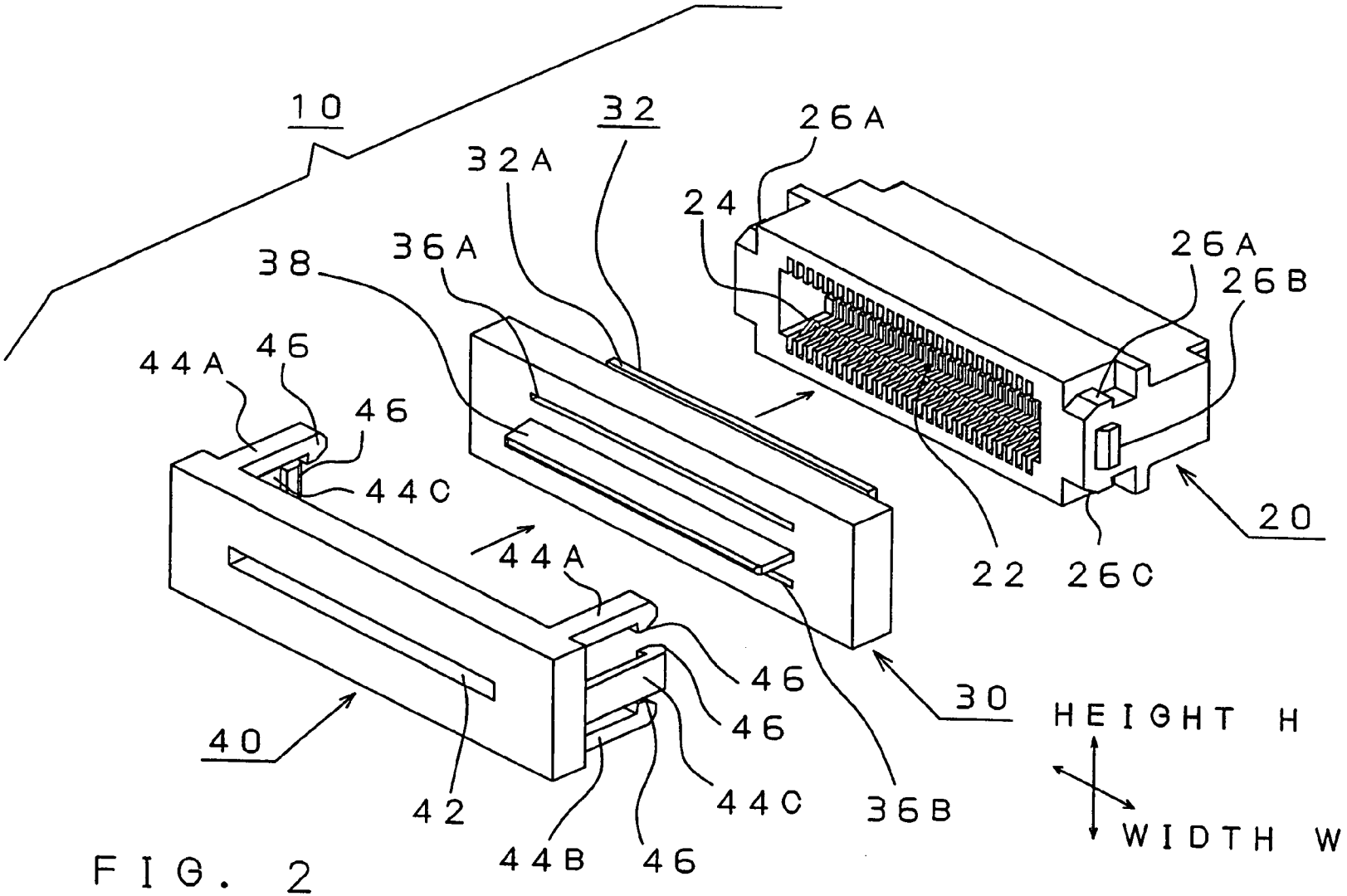
FIG. 2 is a perspective view of the electric connector shown in disassembled.

The insulating housing 20 of the electrical connector 10, as seen from FIG. 2, has on one side thereof a cavity 22 for receiving the connecting end of the above-described flat cable 60 and on another side thereof terminals (not shown) that to be connected to, for instance, computer accessories and other computer hardware products such as a DVD player installed in a computer. The insulating housing 20 is substantially a relatively flat rectangular block. Inside the cavity 22 is (or on the upper and lower inside surfaces of the cavity 22 are respectively) provided with a plurality of contacts 24 arranged laterally in the direction of the width (that corresponds to the longer side of the rectangular block shape) of the insulating housing 20 with, for instance, 0.5 mm pitch, matching the pitch of the conductors of the cable(s) 60.

On either outside of the insulating housing 20 is formed with engaging latch projections. The engaging latch projections comprise upper engaging latch projections 26A, central engaging latch projections 26B, and lower engaging latch projections 26C. Though not seen in FIG. 1, the lower engaging latch projections 26C are provided on the lower surface of the insulating housing 20 so that they are located on the vertically opposite side from the upper engaging latch projections 26A.

The retaining member 30 of the connector is formed with a retainer block 32 that has an upper flat surface 32A and a lower flat surface 32B, thus having at least one flat surface. In other words, the retainer block 32 has a substantially square (or rectangular) shape in cross section (see FIG. 3) and projects from one side of the retaining member 30 toward the insulating housing 20.

The retainer block 32 has a size so that it can be slidably inserted into and snugly fitted in the cavity 22 of the insulating housing 20. In other words, the depth (in the projecting direction) of the retainer block 32 is substantially the same as the interior depth of the cavity 22 and the lateral (widthwise) length is substantially the same as the internal lateral length of the cavity 22. The retainer block 32 is formed with an upper stopper ridge 34A along the far end of the upper flat surface 32A and a lower stopper ridge 34B along the far end of the lower flat surface 32B.

The retaining member 30 is further formed with upper and lower laterally elongated cable slots 36A and 36B so that the bottom of the upper lateral cable slot 36A and the top of the lower lateral cable slot 36B are respectively substantially flush with the upper flat surface 32A and lower flat surface 32B of the retainer block 32.

On another side of the retaining member 30 that faces opposite from the insulating housing 20 is formed with a separation thin flat guide 38 that projects in the direction opposite from the retainer block 32. The flat guide 38 projects from a vertically middle point of the retainer block 32, so that the upper and lower flat surface 32A and 32B of the retainer block and the upper and lower surfaces of the flat guide 38 respectively form steps or a letter Z-shape (see FIG. 3).

The holding member 40 of the connector 10 is formed with a laterally elongated cable opening 42. The cable opening 42 is formed at substantially the middle of the holding member 40 with respect to the vertical direction thereof. Accordingly, the flat guide 38 of the retaining member 30 is brought into this cable opening 42 when the retaining member 30 and the holding member 40 are combined.

In addition, at either lateral end of the holding member 40 is formed with a connecting means that comprises latch arms having engaging projections at the ends. More specifically, the connecting means comprises three, in the shown embodiment, latch arms that includes upper and lower latch arms 44A and 44B and a central latch arm 44C that are formed on lateral ends of the holding member 40 and extend toward the insulating housing 20. At the tip end of each one the latch arms is formed with a latch hook 46; and all three upper, lower and central latch arms 44A through 44C have the length that allows the latch hooks 46 to be disengageably latched to the engaging latch projections 26A through 26C formed on the insulating housing 20.

In the structure described above, the retainer block 32 of the retaining member 30 is brought into the cavity 22 of the insulating housing 20 so that the retaining member 30 and the insulating housing 20 form a single body, and then the holding member 40 is connected to the insulating housing 20 with the retaining member 30 in between by way of allowing the latch hooks 46 of the latch arms 44A through 44C of the holding member 40 to engage with the engaging latch projections 26A through 26C of the insulating housing 20. As a result, the insulating housing 20, the retaining member 30 and the holding member 40 form a single unit connector with the retaining member 30 is sandwiched between the insulating housing 20 and the holding member 40 and with the flat guide 38 of the retaining member 30 inside the cable opening 42 of the holding member 40.

Figure 3:
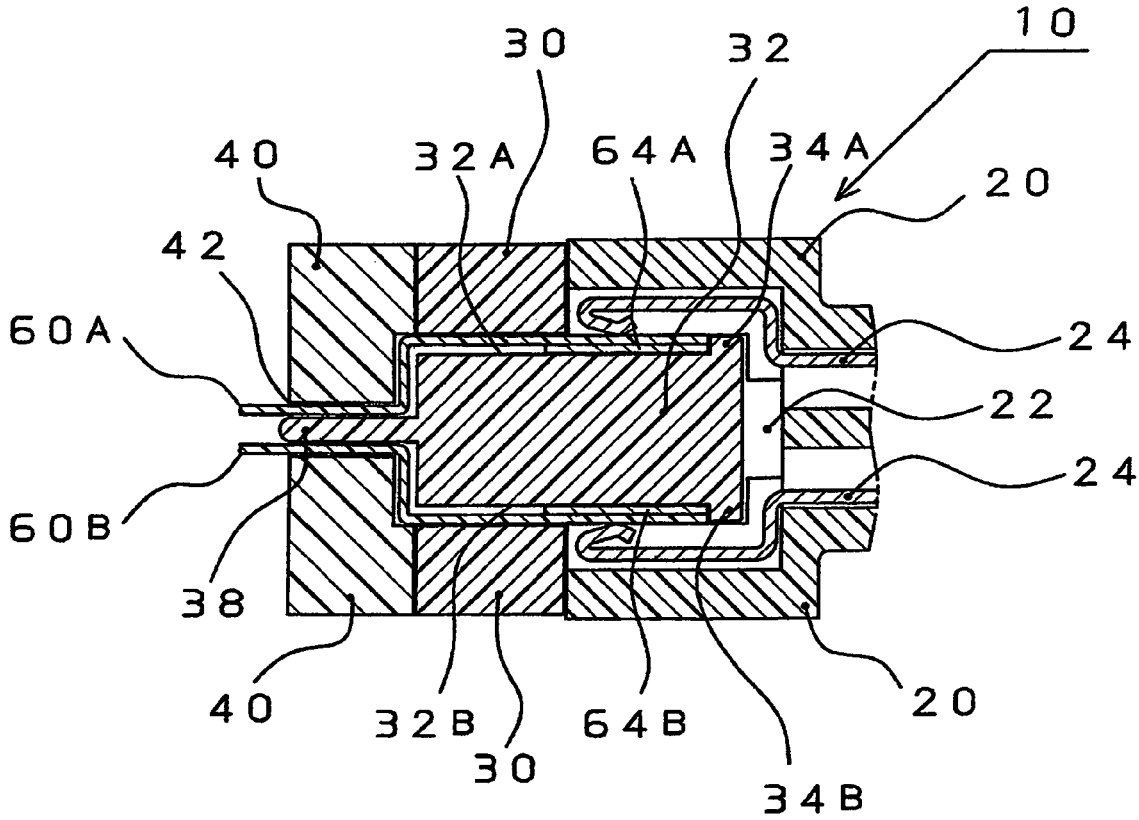
FIG. 3 shows in cross section the crank-shape end portions of the flat type cable inside the connector of the present invention.
Figure 4A:
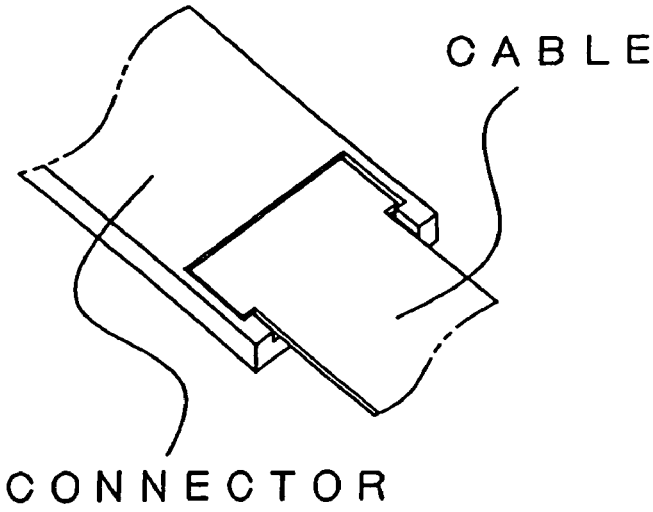
FIG. 4A PRIOR ART
FIGS. 4A and 4B show respectively manners of connection between a flat type cable and a connector in prior art.
Figure 4B:
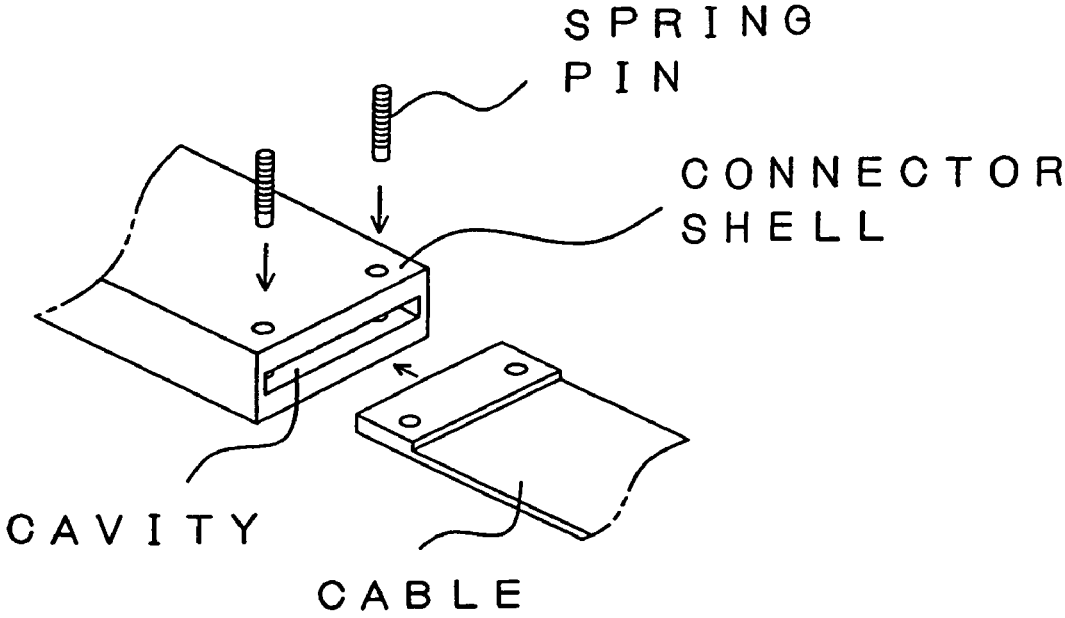
FIG. 4B PRIOR ART

When the above three components (20, 30 and 40) are thus assembled (snapped together) into a single unit to make a connector 10, as seen from FIG. 3, an upper crank-shape cable path is formed inside the connector 10 by the cable opening 42 of the holding member 40, the upper cable slot 36A of the retaining member 30 that is positioned at a higher location in height H than the cable opening 42, and the upper flat surface 32A of the retainer block 32 of the retaining member 30; and in addition, a lower crank-shape cable path is formed inside the connector 10 by the cable opening 42 of the holding member 40, the lower cable slot 36B of the retaining member 30 that is positioned at a lower location in height H than the cable opening 42, and the lower flat surface 32B of the retainer block 32 of the retaining member 30.

In the above description of the upper and lower crank-shape cable paths, the upper cable slot 36A of the retaining member 30 is described to be "at a higher location than the cable opening 42 of the holding member 40," and this is because the upper cable slot 36A is formed above the flat guide 38 in the retaining member 30, and this flat guide 38 is formed so that it is brought into the cable opening 42 of the holding member 40; and the lower cable slot 36B of the retaining member 30 is described to be "at a lower location than the cable opening 42 of the holding member 40," and this is because the lower cable slot 36B is formed below the flat guide 38 in the retaining member 30, and this flat guide 38 is formed so that it is brought into the cable opening 42 of the holding member 40.

Accordingly, upon connecting a flat cable 60 described above to the connector 10, the end portions of the upper and lower cable elements 60A and 60B of the flat cable 60 that have backup elements 64A and 64B are first passed through the lateral cable opening 42 of the holding member 40 and then respectively passed through the upper and lower slots 36A and 36B of the retaining member 30 and respectively brought onto the upper and lower flat surface 32A and 32B of the retainer block 32 of the retaining member 30 until the end edges of the upper and lower cable elements 60A and 60B of the cable 60 respectively come into contact with the upper and lower stopper ridges 34A and 34B of the retainer block 32.

With the backup elements 64A and 64B of the cable 60 being on the retainer block 32, the retaining member 30 is pushed (by an operator or by an appropriate connecting apparatus) toward the insulating housing 20, so that the retainer block 32 of the retaining member 30 slides into the cavity 22 of the insulating housing 20 and is pushed into the cavity 22. Since the retainer block 32 is substantially the same in size as the cavity 22 of the insulating housing 20, with the added thickness of the end portion of the flat cable 60 that has the backup elements 64A and 64B, the retainer block 32 is held inside the cavity 22 of the insulating housing 20 and thus the retaining member 30 and the insulating housing 20 are put into a single unit, and the conductors of the cable 60 are connected to the contacts 24 installed inside the cavity 22 of the insulating housing 20.

Then, the holding member 40 is moved (by an operator or by an appropriate connecting apparatus) toward the insulating housing 20 until the latch hooks 46 at the tip ends of the latch arms 44A through 44C of the connecting means of the holding member 40 are latched to the engaging latch projections 26A through 26C of the insulating housing 20 and the lateral flat guide 38 of the retaining member 30 enters the cable opening 42 of the holding member 40.

As a result, the holding member 40, the retaining member 30 and the insulating housing 20 are put into a single unit to make the connector 10; and due to the engagement made by the latch hooks 46 of the latch arms 44A through 44C of the holding member 40 and the engaging latch projections 26A through 26C of the insulating housing 20, the holding member 40, the retaining member 30 and the insulating housing 20 are securely integrated and prevented from being separated (unless particular disengagement effort is made by, for instance, an operator between the latch hooks 46 and the engaging latch projections 26A through 26C).

When the holding member 40 is thus connected to the insulating housing 20 with the retaining member 30 sandwiched in between, the end portions of the cable that are backed up by the backup elements 64A and 64B are respectively set on the upper and lower flat surfaces 32A and 32B of the retainer block 32 of the retaining member 30, and the portions that are not backed up by the backup elements take a crank shape in the above-described crank-shape cable paths formed inside the connector 10.

As a result, since the end portions of the cable are, as shown in FIG. 3, take a crank shape inside the connector 10 or inside the retaining member 30 and holding member 40, even when the cable 60 is pulled in the direction opposite from the insulating housing 20, the backup elements 64A and 64B, which are stiffer than the cable 60 and are disposed between the inner surfaces of the cavity 22 of the insulating housing 20 and the flat surfaces 32A and 32B of the retainer block 32 of the retaining element 30, does not bend in the crank-shaped cable path, and thus the end portions of the cable including the areas backed up by the backup elements 64A and 64B are securely held by the insulating housing 20, retaining member 30 and holding member 40, and the cable 60 is assuredly prevented from being pulled out of and separated from the connector.

In the above, a description of the present invention is made for the double-layered cable 60. However, a single layered cable that is comprised only of the first or second cable element 60A or 60B is indeed applicable to the connector 10 of the present invention.

What is claimed is:

1. An electrical connector for a flat type cable that has in one end portion thereof a backup element which is stiffer than said cable, said connector comprising:

an insulating housing that has on one side thereof a cavity for receiving said one end portion of said cable and on another side thereof terminals for being connected to an electric device, a retaining member having a retainer block which is formed with at least one flat surface and is slidably inserted into said cavity of said insulating housing, and a holding member engaged with said retaining member and has a connecting means that connects said holding member to said insulating housing with said retaining member in between; and wherein when said insulating housing, retaining member and holding member are assembled together a crank shaped cable path is provided in said electrical connector; and when said backup element of said cable is disposed between an inner surface of said cavity of said insulating housing and said flat surface of said retaining member, said end portion of said cable provided in said crank shaped path and passing through said holding member and retaining member takes a crank shape between said retaining member and said holding member with said backup element positioned on said flat surface of said retainer block of said retaining member.

2. The electrical connector according to claim 1, wherein said retainer block of said retaining member has a substantially square shape in cross section and projects toward said insulating housing so that said retainer block is formed with two flat surfaces.

3. The electrical connector according to claim 1, wherein said connecting means of said holding member is comprised of latch hooks formed at ends of latch arms that extend from both lateral ends of said holding member toward said insulating housing that is formed with engaging latch projections formed at both lateral ends of said insulating housing so as to be latched with said latch hooks of said holding member.

* * * * *